US011493042B2

(12) United States Patent
Brandolin et al.

(10) Patent No.: US 11,493,042 B2
(45) Date of Patent: Nov. 8, 2022

(54) PUMPING UNIT INCLUDING A ROUGH VACUUM PUMP AND A ROOTS VACUUM PUMP

(71) Applicant: PFEIFFER VACUUM, Annecy (FR)

(72) Inventors: Serge Brandolin, Boussy (FR); Mickael Rusconi, Sillingy (FR); Julien Valentin, Cournonterral (FR); Yannick Grenier, Doussard (FR)

(73) Assignee: PFEIFFER VACUUM, Annecy (FR)

( * ) Notice: Subject to any disclaimer, the term of this patent is extended or adjusted under 35 U.S.C. 154(b) by 0 days.

(21) Appl. No.: 17/292,263

(22) PCT Filed: Nov. 15, 2019

(86) PCT No.: PCT/EP2019/081556

§ 371 (c)(1),
(2) Date: May 7, 2021

(87) PCT Pub. No.: WO2020/114754

PCT Pub. Date: Jun. 11, 2020

(65) Prior Publication Data

US 2021/0381509 A1 Dec. 9, 2021

(30) Foreign Application Priority Data

Dec. 3, 2018 (FR) ..... 18 72247

(51) Int. Cl.
*F16L 9/21* (2006.01)
*F04C 25/02* (2006.01)
(Continued)

(52) U.S. Cl.
CPC ..... *F04C 18/126* (2013.01); *F04C 23/00* (2013.01); *F04C 23/003* (2013.01); *F04C 25/02* (2013.01);
(Continued)

(58) Field of Classification Search
CPC ..... F04C 18/126; F04C 25/02; F04C 29/04; F04C 29/12; F04C 23/001; F04C 23/005; F04C 23/00
See application file for complete search history.

(56) References Cited

U.S. PATENT DOCUMENTS 5,494,425 A * 2/1996 Stehr ..... B29B 7/86 96/194
2004/0226622 A1* 11/2004 Hayashi ..... F16L 27/11 138/121
(Continued)

FOREIGN PATENT DOCUMENTS

CN 203867830 U 10/2014
DE 10 2006 004 525 A1 8/2007
(Continued)

OTHER PUBLICATIONS

International Search Report dated Apr. 3, 2020 in PCT/EP2019/081556 filed Nov. 15, 2019, 4 pages.

*Primary Examiner* — Deming Wan
(74) *Attorney, Agent, or Firm* — Oblon, McClelland, Maier & Neustadt, L.L.P.

(57) ABSTRACT

A pumping system is provided, including a rough-vacuum pump; a Roots vacuum pump including a pumping stage having a stator inside which two Roots rotors are configured to rotate synchronously in opposite directions to drive a gas to be pumped between an inlet orifice and an outlet orifice; and a pipeline connecting the outlet orifice to an intake of the rough-vacuum pump, a shortest distance between an edge of the outlet orifice and each of the Roots rotors in the pumping stage being less than 3 cm, and the outlet orifice being situated at the end of an upstream tube of the pipeline that passes into the pumping stage.

20 Claims, 6 Drawing Sheets

(51) Int. Cl.

| | |
|---|---|
| ***F04C 18/12*** | (2006.01) |
| ***F04C 23/00*** | (2006.01) |
| ***F04C 29/04*** | (2006.01) |
| ***F04C 29/12*** | (2006.01) |

(52) U.S. Cl.
CPC ..... *F04C 29/04* (2013.01); *F04C 29/12* (2013.01); *F04C 2220/10* (2013.01); *F04C 2240/806* (2013.01); *F04C 2250/102* (2013.01)

(56) References Cited

U.S. PATENT DOCUMENTS

| | | | | |
|---|---|---|---|---|
| 2013/0280062 | A1 | 10/2013 | Suzuki et al. | |
| 2014/0093412 | A1* | 4/2014 | Stones | F04C 18/082 418/209 |

FOREIGN PATENT DOCUMENTS

| | | | |
|---|---|---|---|
| DE | 10 2011 000 732 | B3 | 8/2012 |
| JP | 2011-163150 | A | 8/2011 |
| WO | WO 2018/184853 | A1 | 10/2018 |

* cited by examiner

PUMPING UNIT INCLUDING A ROUGH VACUUM PUMP AND A ROOTS VACUUM PUMP

The present invention relates to a pumping unit having a rough-vacuum pump and a Roots vacuum pump mounted in series with and upstream of the rough-vacuum pump in the direction of flow of the gases to be pumped.

Some pumping units are employed in processes known as "powder" processes since they involve gases that generate large quantities of solid by-products. This is the case for example for some methods for manufacturing semiconductors.

These solid compounds can settle on the internal surfaces of the vacuum pumps and form agglomerates that can ultimately limit the passage dimensions for the gases and thus result in losses of pumping capacity.

These powders accumulate relatively quickly compared with the lifetime of the vacuum pumps, thereby limiting the period of use of the pumps without maintenance operations. The pipeline connecting the two vacuum pumps is particularly conducive to deposits, in particular when it has highly bent portions, and therefore has to be removed frequently to be cleaned. However, on account of its confined position between the pumps and on account of its large dimensions, this inter-pump pipeline can prove difficult to remove without also making it necessary to remove at least one of the two pumps.

In addition to being frequent, maintenance can thus be relatively time-consuming and complicated.

It is an aim of the present invention to propose an improved pumping unit that at least partially solves one of the drawbacks of the prior art.

To this end, the subject of the invention is a pumping unit having:

- a rough-vacuum pump,
- a Roots vacuum pump comprising a pumping stage having a stator inside which two Roots rotors are configured to rotate synchronously in opposite directions to drive a gas to be pumped between an inlet orifice and an outlet orifice,
- a pipeline connecting the outlet orifice to an intake of the rough-vacuum pump.

The shortest distance between an edge of the outlet orifice and each of the rotors in the pumping stage is for example at least less than three centimetres.

The pumping unit may have one or more of the features described below, separately or in combination.

The shortest distance is for example less than two centimetres, for instance less than one centimetre, for instance less than 0.5 centimetre, for instance greater than 0.1 cm.

This distance is the shortest when, in operation, the rotors are moved, each in turn, as close as possible to the outlet orifice. The outlet orifice is generally situated equidistantly from the axes of the rotors. The distance is thus the same between each of the two rotors and the outlet orifice.

The outlet orifice of the Roots vacuum pump is thus brought closer to the area swept by the rotors. This has the effect that, as they rotate, the rotors can sweep powders that have accumulated on the edges of the outlet orifice. Any accumulation of powder protruding from the outlet orifice can thus be scraped automatically by way of a mechanical effect and entrained with the pumped gases out of the pumping stage. The edge of the outlet orifice can thus be cleaned by the rotors at least as soon as the accumulation of powders exceeds the value of the distance between the edge of the outlet orifice and the area delimited by the sweeping of the rotors. This geometry makes it possible to reduce clogging by the powders in the pumping stage by maintaining a permanent passage for the gases and the powders transported towards the rough-vacuum pump without allowing the powders to accumulate at the delivery of the Roots vacuum pump. It is thus possible to reduce losses of pumping capacity at the outlet of the Roots vacuum pump.

The outlet orifice for example has a circular shape, the diameter of which is less than five centimetres, for instance between two and five centimetres. An outlet orifice having such dimensions forms a restriction compared with the overall dimensions of an outlet orifice of a Roots vacuum pump. This restriction makes it possible to accelerate the gases as soon as they exit the rotors, making it easier to entrain the powders with the pumped gases. Moreover, the pressure drop brought about by this restriction in the flow of the pumped gases is negligible with respect to the overall performance of the pumping unit.

The pipeline may be straight. It is thus possible to limit the accumulation of powders in the pipeline, these then being entrained by the pumped gases and by gravity.

According to a first example, the outlet orifice is situated at the end of an upstream tube of the pipeline that passes into the pumping stage. The upstream tube passing into the stator makes it possible to bring the outlet orifice closer to the rotors in a simple manner, by extending the pipeline in the stator.

The upstream tube may project from an outlet receptacle of the pumping stage. The outlet receptacle makes it possible to form a storage reservoir for some of the powders evacuated from the outlet orifice by the rotation of the rotors. Some of the powders can thus accumulate in the dead zone of the outlet receptacle without blocking the outlet orifice of the Roots vacuum pump, while another part of the powders is carried into the pipeline with the pumped gases.

Moreover, once the outlet receptacle is full, the accumulated powders that protrude from the outlet receptacle can likewise be swept by the rotors and sent into the pipeline with the pumped gases.

According to one exemplary embodiment, the pumping unit also has a cooling circuit configured to at least partially cool the upstream tube of the pipeline, for example by circulation of a coolant such as water at ambient temperature. Specifically, it may be advantageous to lower the temperature of the upstream tube, for example by several tens of degrees Celsius, for example in order to remain below a maximum temperature of between 100 and 250° C., for instance 200° C., in order to avoid any polymerization of the powders that could agglomerate, accumulate and harden on the upstream tube, the downstream portion of the pipeline or the rough-vacuum pump.

The cooling circuit has for example a jacket surrounding a base of the upstream tube, an inlet and an outlet of the jacket allowing a coolant to flow through the double wall formed by the jacket and the upstream tube.

The inlet is for example situated at the end of an inlet pipe of the cooling circuit and the outlet is situated at the end of an outlet pipe of the cooling circuit, the inlet pipe and outlet pipe projecting into the volume of the double wall. The inlet pipe and outlet pipe protrude for example vertically from the bottom, parallel to the upstream tube. The inlet pipe and outlet pipe are for example diametrically opposed in the volume of the double wall. The length of the outlet pipe may be greater than the length of the inlet pipe. This arrangement makes it possible to ensure minimum filling in the double wall and allows the coolant to sweep equally over the height of the jacket.

According to another exemplary embodiment, the cooling circuit has a coil that surrounds a base of the upstream tube and passes through the bottom in order to connect an inlet and an outlet of the coil to an external coolant circuit.

A bottom at least of the outlet receptacle may be removable. It is thus possible to extract the powders from the pumping stage without it being necessary to remove the vacuum pumps.

According to one exemplary embodiment, the outlet receptacle has, for the one part, a circumferential portion formed in the stator of the pumping stage and, for the other part, a bottom fastened to the upstream tube of the pipeline.

When the pumping unit has a frame configured to support the Roots vacuum pump, the pipeline may also have a downstream portion that is detachable from the upstream tube. The detachable downstream portion allows the latter to be able to be removed without it being necessary to detach the upstream tube of the pipeline. The upstream tube can remain in place, fastened to the stator of the pumping stage, the Roots vacuum pump being supported by the frame. It is then possible to clean the upstream tube, or the inside of the outlet receptacle, from the outside, for example with the aid of a bottle brush. The partial removal of the pipeline thus allows easier and quicker maintenance that does not require the removal of the pumps.

The downstream portion of the pipeline may have a bellows.

According to a second exemplary embodiment, the outlet orifice of the pumping stage is provided in the stator of the pumping stage.

For example, the outlet orifice is formed in a flat portion of the stator of elongate cross section.

According to another example, the stator has a turned-in wall in which the outlet orifice is provided. The turned-in wall may be formed by a raised flat wall, the raised portion following the shape of the path of the rotors. The shortest distance between the outlet orifice and the area delimited by the sweeping of the rotors in the pumping stage can thus be reduced to a greater extent.

PRESENTATION OF THE DRAWINGS

Further advantages and features will become apparent from reading the following description of a particular, but non-limiting, embodiment of the invention and from the appended drawings, in which.

In these figures, identical elements bear the same reference numerals.

The following embodiments are examples. Although the description refers to one or more embodiments, this does not necessarily mean that each reference relates to the same embodiment, or that the features apply only to one embodiment. Simple features of different embodiments can also be combined or interchanged in order to provide further embodiments.

A rough-vacuum pump is defined as being a positive displacement vacuum pump that is configured, using two rotors, to take in, transfer and then deliver the gas to be pumped at atmospheric pressure. The rotors are carried by two shafts that are driven in rotation by a motor of the rough-vacuum pump.

A Roots vacuum pump (also known as a "Roots blower") is defined as being a positive displacement vacuum pump that is configured, using Roots rotors, to take in, transfer and then deliver the gas to be pumped. The Roots vacuum pump is mounted upstream of and in series with a rough-vacuum pump. The rotors are carried by two shafts that are driven in rotation by a motor of the Roots vacuum pump.

The term "upstream" is understood as meaning an element that is placed in front of another with respect to the direction of circulation of the gas. By contrast, the term "downstream" is understood as meaning an element that is placed after another with respect to the direction of circulation of the gas to be pumped,.

Figure 1:
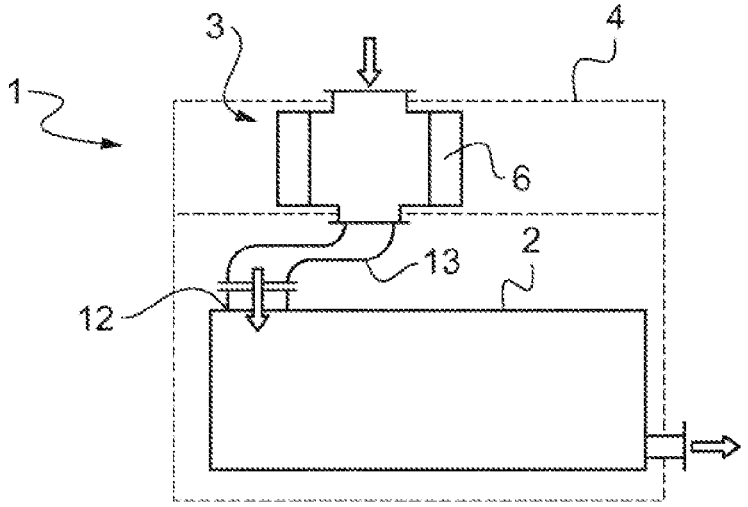
FIG. 1 shows a schematic view of a pumping unit according to a first exemplary embodiment.

FIG. 1 shows a pumping unit 1 intended to be connected to a process chamber for pumping gases (the direction of flow of the pumped gases is illustrated by the arrows in FIG. 1). It may be a chamber in which deposition and etching processes that are used in the manufacture of microelectronic devices on silicon wafers take place.

The pumping unit 1 has a rough-vacuum pump 2 and a Roots vacuum pump 3.

The rough-vacuum pump 2 is for example a multistage vacuum pump of the "Roots" or "claw" type or of the spiral or screw type or based on another similar positive displacement vacuum pump principle. The delivery pressure of the rough-vacuum pump 2 is atmospheric pressure.

The Roots vacuum pump 3 is mounted in series with and upstream of the rough-vacuum pump 2 in the direction of flow of the pumped gases. The Roots vacuum pump 3 is for example situated spatially upstream of the rough-vacuum pump 2 in a frame 4 of the pumping unit 1.

The Roots vacuum pump 3 is, like the rough-vacuum pump 2, a positive displacement vacuum pump which, using rotors 5 that are driven in rotation by a motor 6, takes in, transfers and then delivers the gas to be pumped.

Figure 2:
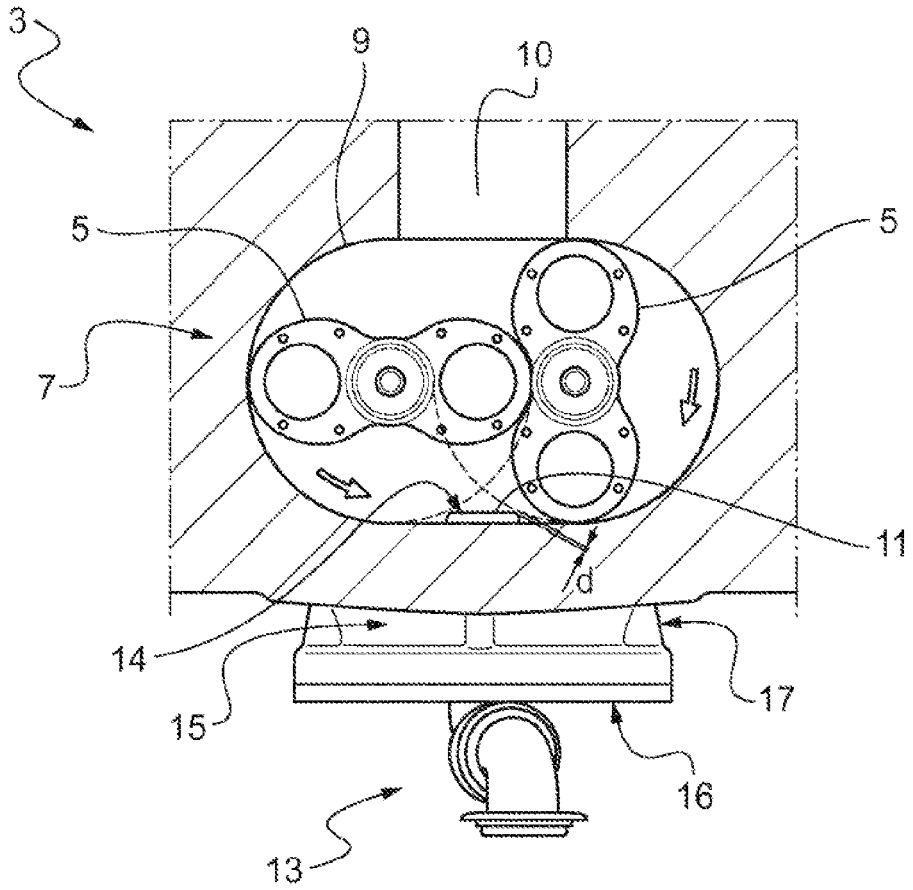
FIG. 2 shows a view of a Roots vacuum pump in cross section and of a pipeline of the pumping unit in FIG. 1.

As can be seen more clearly in the view in section in FIG. 2, the Roots vacuum pump 3 comprises a pumping stage 7 having a stator 9 inside which two Roots rotors 5 are angularly offset and configured to rotate synchronously in opposite directions in order to drive a gas to be pumped between an inlet orifice 10 and an outlet orifice 11 of the pumping stage 7. The stator 9 delimits the housing of the pumping stage 7 that receives the rotors 5. It is generally made of cast iron.

During rotation, the gas taken in from the inlet orifice 10 is trapped in the volume created by the rotors 5 and the stator 9, and is then entrained by the rotors 5 towards the outlet orifice 11 (the direction of rotation of the rotors 5 is illustrated by the arrows in FIG. 2).

The Roots vacuum pump 3 is said to be "dry" since, during operation, the rotors 5 rotate inside the stator 9 without any mechanical contact with the stator 9, this making it possible not to use oil in the pumping stage 7.

The Roots vacuum pump 3 may have an additional pumping stage in series with and upstream of the pumping stage 7. The rotors 5 of the two pumping stages are then driven simultaneously in rotation by the same motor 6 of the Roots vacuum pump 3.

The outlet orifice 11 is the orifice of the pumping stage 7 through which the pumped gases exit. It is connected to an intake 12 of the rough-vacuum pump 2 by a pipeline 13 of the pumping unit 1, made for example at least partially of stainless steel.

Figure 4:
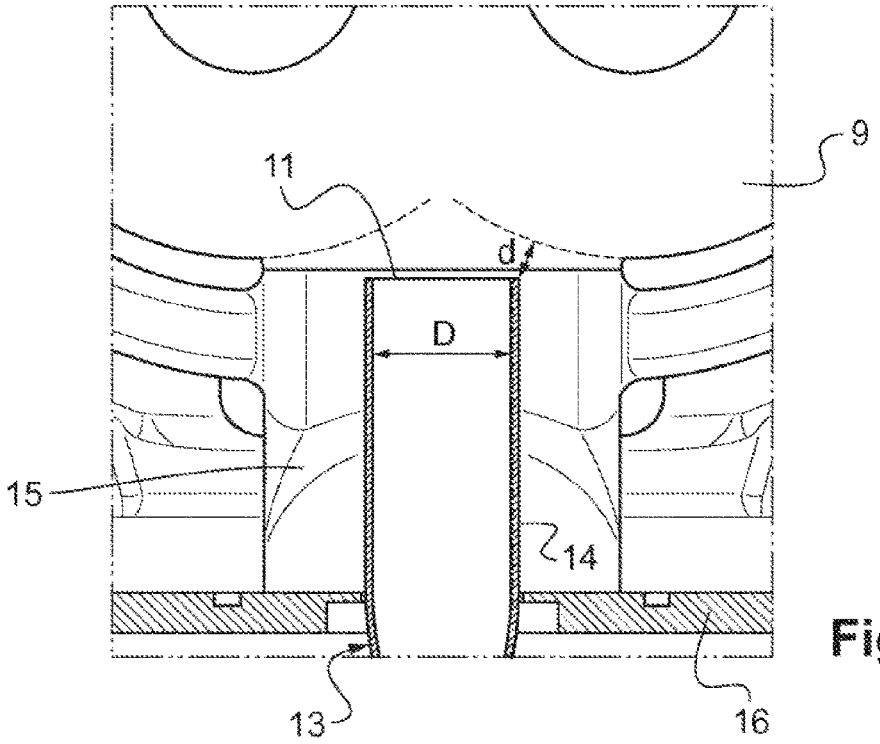
FIG. 4 shows an enlarged view in section of a detail of the elements of FIG. 3.

The shortest distance of between an edge of the outlet orifice 11 and each of the rotors 5 in the pumping stage 7 is for example at least less than three centimetres, for instance less than two centimetres, for instance less than one centimetre, for instance less than 0.5 centimetre, for instance greater than 0.1 cm (FIG. 4).

This distance d is the shortest when, in operation, the rotors 5 are moved, each in turn, as close as possible to the outlet orifice 11. The outlet orifice 11 is generally situated equidistantly from the axes of the rotors 5. The distance d is thus the same between each of the two rotors 5 and the outlet orifice 11.

The outlet orifice 11 of the Roots vacuum pump 3 is thus brought closer to the area swept by the rotors 5. This has the effect that, as they rotate, the rotors 5 can sweep powders that have accumulated on the edges of the outlet orifice 11. Any accumulation of powder protruding from the outlet orifice 11 can thus be scraped automatically by way of a mechanical effect and entrained with the pumped gases out of the pumping stage 7. The edge of the outlet orifice 11 can thus be cleaned by the rotors 5 at least as soon as the accumulation of powders exceeds the value of the distance d between the edge of the outlet orifice 11 and the area delimited by the sweeping of the rotors 5. This geometry makes it possible to reduce clogging by the powders in the pumping stage 7 by maintaining a permanent passage for the gases and the powders transported towards the rough-vacuum pump 2 without allowing the powders to accumulate at the delivery of the Roots vacuum pump 3. It is thus possible to reduce losses of pumping capacity at the outlet of the pumping stage 7 of the Roots vacuum pump 3.

The outlet orifice 11 (its edge) has for example a circular shape, the diameter D of which is less than five centimetres, for instance between two and five centimetres. An outlet orifice 11 having such dimensions forms a restriction compared with the overall dimensions of an outlet orifice of a Roots vacuum pump. This restriction makes it possible to accelerate the gases as soon as they exit the rotors 5, making it easier to entrain the powders with the pumped gases. Moreover, the pressure drop brought about by this restriction in the flow of the pumped gases is negligible with respect to the overall performance of the pumping unit 1.

According to a first exemplary embodiment that can be seen in FIGS. 2 to 5, the outlet orifice 11 is situated at the end of an upstream tube 14 of the pipeline 13 that passes into the pumping stage 7.

The upstream tube 14 may project from an outlet receptacle 15 of the pumping stage 7. The upstream tube 14 is for example a straight cylinder extending vertically from the bottom 16 of the outlet receptacle 15. The upstream tube 14 measures for example between 70 and 100 mm.

The outlet receptacle 15 makes it possible to form a storage reservoir for some of the powders evacuated from the outlet orifice 11 by the rotation of the rotors 5. Some of the powders can thus accumulate in the dead zone of the outlet receptacle 15 without blocking the outlet orifice 11 of the Roots vacuum pump 3, while another part of the powders is carried into the pipeline 13 with the pumped gases.

The powders that have accumulated in the outlet receptacle 15 do not impair the pumping performance of the Roots vacuum pump 3.

Moreover, once the outlet receptacle 15 is full, the accumulated powders that protrude from the outlet receptacle 15 can likewise be swept by the rotors 5 and sent into the pipeline 13 with the pumped gases.

The bottom 16 at least of the outlet receptacle 15 is for example removable, making it possible to easily empty the powders from the receptacle 15 for the possible cleaning thereof. It is thus possible to extract the powders from the pumping stage 7 without it being necessary to remove the vacuum pumps 2, 3.

Figure 3:
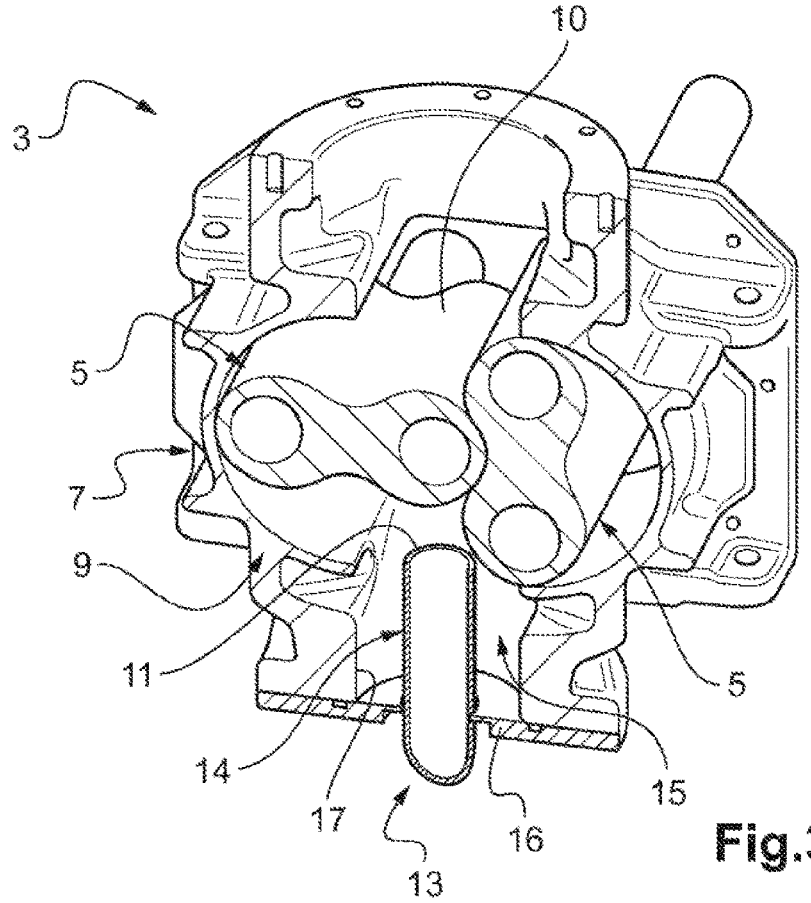
FIG. 3 shows a view in section of elements of the Roots vacuum pump and of the pipeline in FIG. 2.

In the exemplary embodiment in FIGS. 2 and 3, the outlet receptacle 15 has, for the one part, a circumferential portion 17 formed in the stator 9 of the pumping stage 7 and, for the other part, a bottom 16 fastened to the upstream tube 14 of the pipeline 13. The circumferential portion 17 has for example a conical or cylindrical overall shape.

A seal may be disposed between the circumferential portion 17 and the bottom 16. An annular groove 18 may be formed in the bottom 16 in order to receive the seal.

Figure 5:
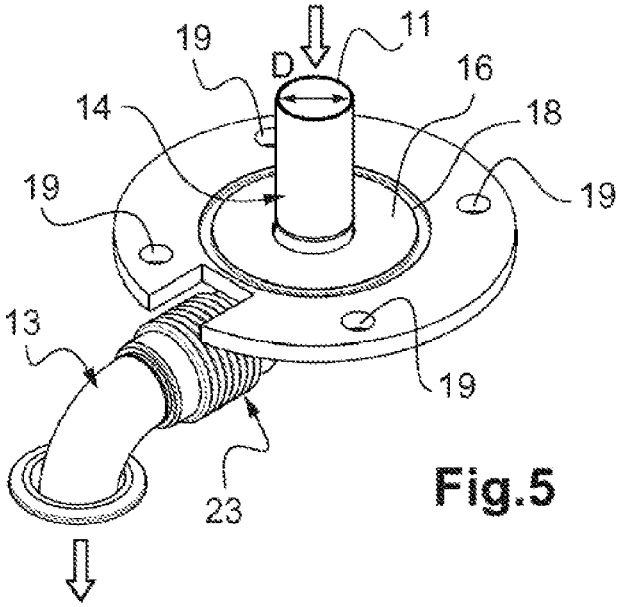
FIG. 5 shows a perspective view of the pipeline of the pumping unit in FIG. 2 fastened to a bottom of an outlet receptacle.

The bottom 16 may be fastened to the circumferential portion 17 by first conventional fastening means, such as screws inserted into the stator 9, passing through holes 19 in an annular flange of the bottom 16 (FIG. 5).

It will be understood that the upstream tube 14 that passes into the stator 9 makes it possible to bring the outlet orifice 11 closer to the rotors 5. This bringing of the outlet orifice 11 closer can be effected easily, by way of extension of the pipeline 13 and, in this case, by the fastening of a bottom 16 to the upstream tube 14, the bottom 16 having fastening means that are compatible with the stator 9 of the pumping stage 7.

Figure 6:
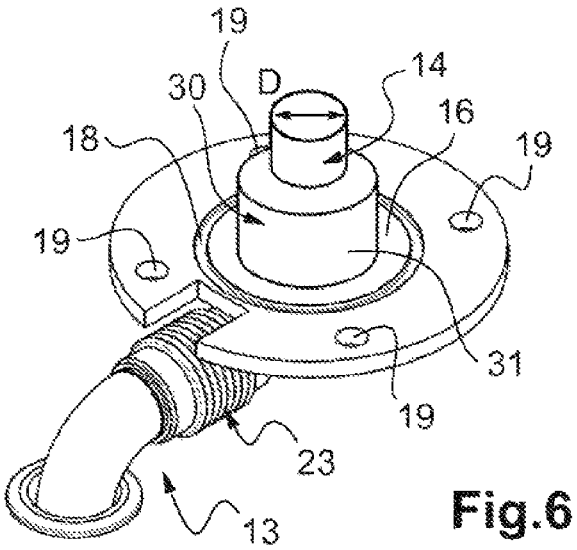
FIG. 6 shows a view similar to FIG. 5 for a second exemplary embodiment of the pumping unit.
Figure 7:
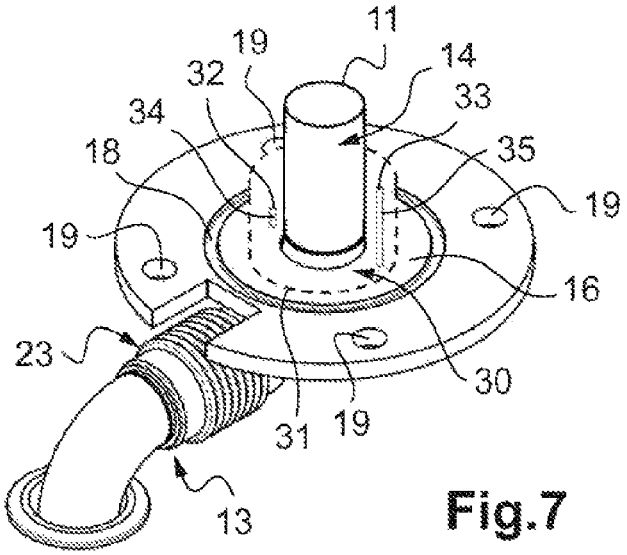
FIG. 7 is a view similar to FIG. 6, showing a jacket of a cooling circuit using a dotted line.
Figure 8:
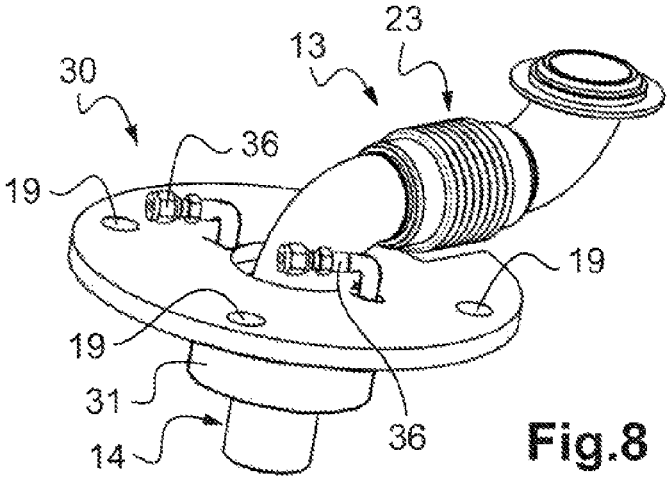
FIG. 8 is a turned-over view of the elements in FIG. 6.

FIGS. 6, 7 and 8 show an embodiment variant.

In this variant, the pumping unit 1 also has a cooling circuit 30 configured to at least partially cool the upstream tube 14 of the pipeline 13. Specifically, it may be advantageous to lower the temperature of the upstream tube 14, for example by several tens of degrees Celsius, in order to remain below a maximum temperature of between 100° C. and 250° C., for instance 200° C., in order to avoid any polymerization of the powders that could agglomerate, accumulate and harden on the upstream tube 14, the downstream portion of the pipeline 13 or the rough-vacuum pump 2.

The cooling circuit 30 has for example a jacket 31 surrounding a base of the upstream tube 14 (FIGS. 6 and 7). The jacket 31 has for example a cylindrical shape coaxial with the upstream tube 14. The jacket 31 extends from the bottom 16 of the outlet receptacle 15 to a height less than the height of the upstream tube 14, for instance to a height greater than three quarters, for instance at a distance of between one and two centimetres from the outlet orifice 11, so as not to impair the rotation of the rotors 5. The height of the jacket 31 is for example between 60 and 80 mm.

The jacket 31 has an inlet 32 and an outlet 33, allowing a coolant to flow through the volume of the double wall formed by the jacket 31 and the upstream tube 14 (FIG. 7). The coolant is for example water at ambient temperature.

According to one exemplary embodiment, the inlet 32 is situated at the end of an inlet pipe 34 of the cooling circuit 30 projecting into the volume of the double wall and the outlet 33 is situated at the end of an outlet pipe 35 of the cooling circuit 30 projecting into the volume of the double wall. The inlet pipe 34 and outlet pipe 35 are for example straight cylinders. They protrude vertically from the bottom 16, parallel to the upstream tube 14. The inlet pipe 34 and outlet pipe 35 are for example diametrically opposed in the volume of the double wall.

Moreover, the length of the outlet pipe 35 may be greater than the length of the inlet pipe 34. The length of the outlet pipe 35 is for example more than four times greater than the length of the inlet pipe. For example, the inlet pipe 34 measures 1 cm and the outlet pipe 35 measures 6 cm, the diameters being the same and for example 6 mm. In other words, in the jacket 31, the outlet 33 is higher than the inlet 32. This arrangement makes it possible to ensure minimum filling in the double wall and allows the coolant to sweep equally over the height of the jacket 31.

The inlet pipe 34 and outlet pipe 35 pass through the bottom 16 and bear connectors 36 of the cooling circuit 30 that are situated on the outside of the stator 9 for connecting the cooling circuit 30 to an external coolant circuit (FIG. 8).

According to another exemplary embodiment, the cooling circuit has a coil that surrounds a base of the upstream tube 14 (not shown) and passes through the bottom 16 in order to connect an inlet and an outlet of the coil to an external coolant circuit.

Figure 9:
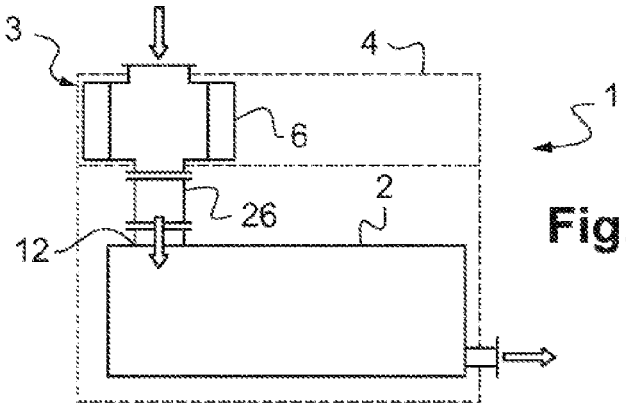
FIG. 9 shows a view similar to FIG. 1 for a third exemplary embodiment of the pumping unit.

Although FIGS. 1 to 8 show a pipeline 13 having two bent portions, it is also conceivable to provide a pipeline 26 which does not have bends but is straight, as shown in FIG. 9. The straight pipeline 26 is arranged vertically between the two vacuum pumps 2, 3. In this way, it is possible to limit the accumulation of powders in the pipeline 26, these then being entrained by the pumped gases and by gravity.

It is also possible to provide an outlet orifice 11 that has a smaller diameter than the diameter of the pipeline 13, 21. Preference is given to pipeline diameters that are constant or increase in the direction of flow of the gases in order to avoid the formation of edges that are likely to receive depositions of powders.

Figure 10:
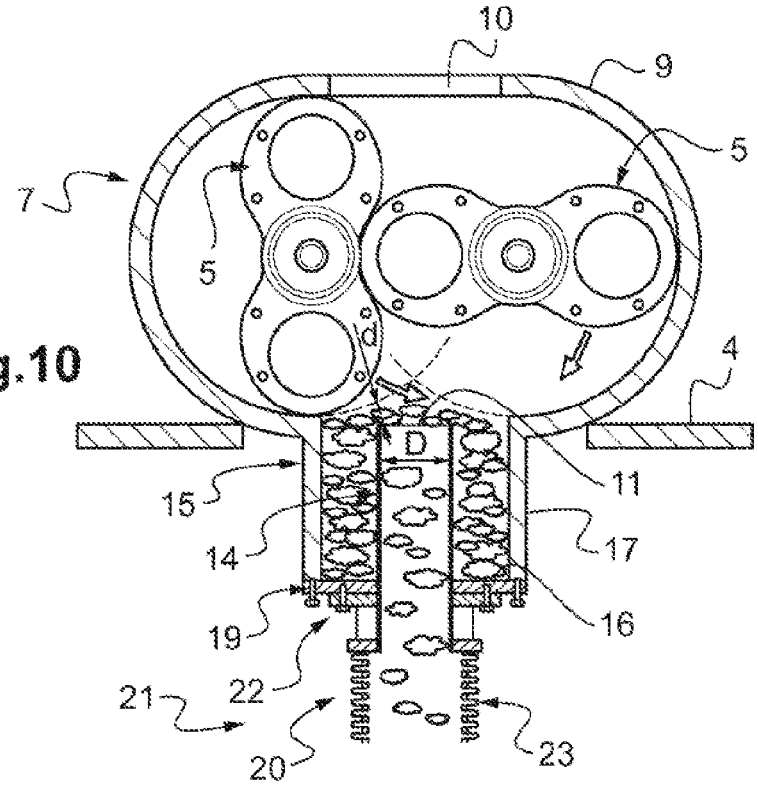
FIG. 10 shows a schematic view in section of a Roots vacuum pump in cross section and of a pipeline of the pumping unit for a fourth exemplary embodiment of the pumping unit.

According to an exemplary embodiment that can be seen in FIG. 10, the frame 4 is configured to support the Roots vacuum pump 5. Moreover, a downstream portion 20 of the pipeline 21 is detachable from the upstream tube 14. The downstream portion 20 has for example two fastening means 22 that are designed to fasten the downstream portion 20 to the bottom 16 of the outlet receptacle 15 in a removable manner, for example using screws.

The detachable downstream portion 20 allows the latter to be able to be removed without it being necessary to detach the upstream tube 14 of the pipeline 21. The upstream tube 14 can remain in place, fastened to the stator 9 of the pumping stage 7, the Roots vacuum pump 3 being supported by the frame 4. It is then possible to clean the upstream tube 14, or the inside of the outlet receptacle 15, from the outside, for example with the aid of a bottle brush. The partial removal of the pipeline 21 thus allows easier and quicker maintenance that does not require the removal of the pumps 2, 3.

The downstream portion 20 may also have a bellows 23 for making the connection between the pumps 2, 3 easier.

Figure 11:
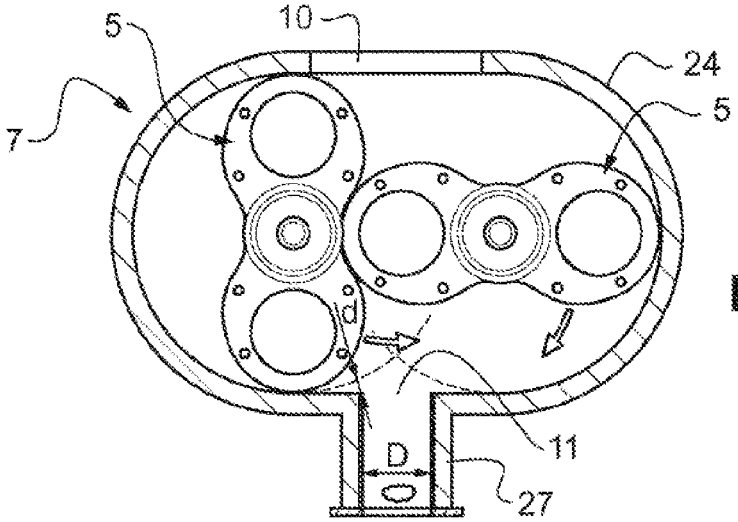
FIG. 11 shows a view similar to FIG. 10 for a fifth exemplary embodiment of the pumping unit.

It is also possible not to provide an outlet receptacle. The outlet orifice 11 is then provided directly in the stator 24 of the pumping stage 7 (FIG. 11).

In this case, the pipeline 27 has for example, for the one part, a portion formed in the cast iron of the pumping stage 7 and, for the other part, a tube, which is or is not bent and is made for example of stainless steel, connecting the cast iron to the intake 12 of the rough-vacuum pump 2.

The outlet orifice 11 is formed for example in a flat portion of a bottom of a stator 24 of elongate cross section.

Figure 12:
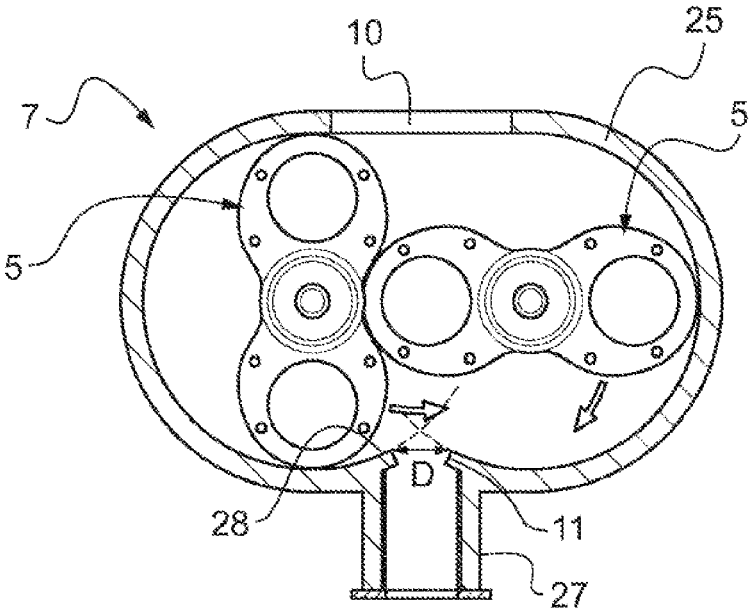
FIG. 12 shows a view similar to FIG. 10 for a sixth exemplary embodiment of the pumping unit.
Figure 13:
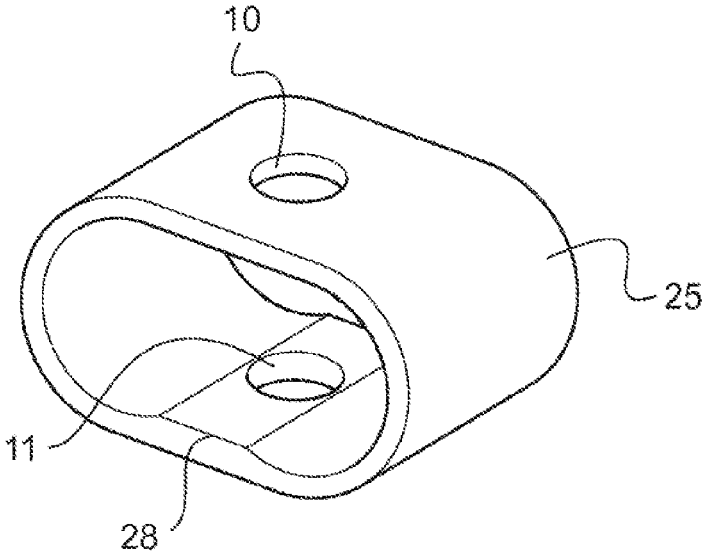
FIG. 13 shows a schematic perspective view of a stator of a Roots vacuum pump of a pumping unit according to the sixth exemplary embodiment.

According to another exemplary embodiment that is shown in FIGS. 12 and 13, the stator 25 of the pumping stage 7 has a turned-in wall 28 in which the outlet orifice 11 is provided.

This turned-in wall 28 is formed for example by a flat wall that is raised with respect to the bottom of the stator, the raised portion following for example the shape of the path of the rotors 5, that is to say for example the 8-shaped cross section of the rotors 5.

The turned-in wall 28 thus makes it possible to bring the outlet orifice 11 closer to the rotors 5. The shortest distance d between the outlet orifice 11 and the area delimited by the sweeping of the rotors 5 in the pumping stage 7 can thus be reduced to a greater extent.

The invention claimed is:

1. A pumping unit, comprising:

a rough-vacuum pump;

a Roots vacuum pump comprising a pumping stage having a stator inside which two Roots rotors are configured to rotate synchronously in opposite directions to drive a gas to be pumped between an inlet orifice and an outlet orifice; and a pipeline connecting the outlet orifice to an intake of the rough-vacuum pump, wherein a shortest distance between an edge of the outlet orifice and surfaces of each of the Roots rotors in the pumping stage is less than 3 cm, the outlet orifice being situated at the end of an upstream tube of the pipeline that passes into the pumping stage.

2. The pumping unit according to claim 1, wherein the shortest distance is less than 2 cm.

3. The pumping unit according to claim 1, wherein the shortest distance is greater than 0.1 cm.

4. The pumping unit according to claim 1, wherein the outlet orifice has a circular shape, a diameter of which is less than 5 cm.

5. The pumping unit according to claim 1, wherein the outlet orifice has a circular shape, a diameter of which is between 2 cm and 5 cm.

6. The pumping unit according to claim 1, wherein the upstream tube projects from an outlet receptacle of the pumping stage.

7. The pumping unit according to claim 6, wherein at least a bottom of the outlet receptacle is removable.

8. The pumping unit according to claim 6, wherein the outlet receptacle has, for one part, a circumferential portion formed in the stator of the pumping stage and, for another part, a bottom fastened to the upstream tube of the pipeline.

9. The pumping unit according to claim 1, further comprising a cooling circuit configured to at least partially cool the upstream tube of the pipeline.

10. The pumping unit according to claim 9, wherein the cooling circuit includes a jacket surrounding a base of the upstream tube of the pipeline, an inlet, and an outlet of the jacket allowing a coolant to flow through a volume of the double wall formed by the jacket and the upstream tube.

11. The pumping unit according to claim 10, wherein the inlet is situated at the end of an inlet pipe of the cooling circuit and the outlet is situated at the end of an outlet pipe of the cooling circuit, the inlet pipe and outlet pipe projecting into the volume of the double wall.

12. The pumping unit according to claim 11, wherein the length of the outlet pipe is greater than the length of the inlet pipe.

13. The pumping unit according to claim 1, further comprising a frame configured to support the Roots vacuum pump, wherein the pipeline has a downstream portion that is detachable from the upstream tube.

14. The pumping unit according to claim 13, wherein the downstream portion has a bellows.

15. The pumping unit according to claim 1, wherein the pipeline is straight.

16. A pumping unit, comprising:

a rough-vacuum pump;

a Roots vacuum pump comprising a pumping stage having a stator inside which two Roots rotors are configured to rotate synchronously in opposite directions to drive a gas to be pumped between an inlet orifice and an outlet orifice; and a pipeline connecting the outlet orifice to an intake of the rough-vacuum pump, wherein the outlet orifice is situated at the end of an upstream tube of the pipeline that passes into the pumping stage.

17. The pumping unit according to claim 16, wherein the upstream tube projects from an outlet receptacle of the pumping stage.

18. The pumping unit according to claim 16, further comprising a cooling circuit configured to at least partially cool the upstream tube of the pipeline.

19. The pumping unit according to claim 18, wherein the cooling circuit includes a jacket surrounding a base of the upstream tube of the pipeline, an inlet, and an outlet of the jacket allowing a coolant to flow through a volume of the double wall formed by the jacket and the upstream tube.

20. The pumping unit according to claim 19, wherein the inlet is situated at the end of an inlet pipe of the cooling circuit and the outlet is situated at the end of an outlet pipe of the cooling circuit, the inlet pipe and outlet pipe projecting into the volume of the double wall.

* * * * *